US006179258B1

(12) United States Patent
Dell'Aquila

(10) Patent No.: US 6,179,258 B1
(45) Date of Patent: Jan. 30, 2001

(54) DECORATIVE LIGHT SUPPORT FRAME WITH ADJUSTABLE LENGTH FRAME MEMBERS

(76) Inventor: Joseph C. Dell'Aquila, 39 W. 131 Chisholm Ter., Elgin, IL (US) 60123

( * ) Notice: Under 35 U.S.C. 154(b), the term of this patent shall be extended for 0 days.

(21) Appl. No.: 09/260,898

(22) Filed: Mar. 1, 1999

(51) Int. Cl.[7] ..... A47F 5/00

(52) U.S. Cl. ..... 248/208; D11/155; 248/314; 362/252; 362/389

(58) Field of Search ..... 248/208, 314; 362/249, 250, 251, 252, 125, 151, 389; D26/25, 35, 138; D11/159, 156

(56) References Cited

U.S. PATENT DOCUMENTS

| | | | | |
|---|---|---|---|---|
| D. 403,801 | | 1/1999 | Summers | D26/138 |
| 3,872,971 | * | 3/1975 | Dinsmore, Jr. et al. | 211/13 |
| 4,357,653 | | 11/1982 | Kovacs | 362/388 |
| 4,385,346 | * | 5/1983 | Spicer | 362/382 |
| 4,587,921 | * | 5/1986 | Curry | 114/363 |
| 4,657,242 | * | 4/1987 | Guridi | 272/62 |
| 4,795,121 | | 1/1989 | Comito | 248/314 |
| 4,821,158 | * | 4/1989 | Mitten | 362/149 |
| 4,852,832 | | 8/1989 | Delaney | 248/65 |
| 4,995,181 | * | 2/1991 | Wolf | 40/152.2 |
| 5,080,681 | * | 1/1992 | Erb | 623/63 |
| 5,580,160 | | 12/1996 | Schuler | 362/249 |
| 5,700,083 | * | 12/1997 | Boeschel | 362/249 |
| 5,873,556 | * | 2/1999 | Reiker | 248/323 |
| 5,954,419 | * | 9/1999 | D'Angelo | 362/152 |
| 6,033,088 | * | 3/2000 | Contigiani | 362/249 |

* cited by examiner

*Primary Examiner*—Leslie A. Braun
*Assistant Examiner*—Walter Landry
(74) *Attorney, Agent, or Firm*—Emrich & Dithmar

(57) ABSTRACT

A support frame for decorative lights disposed about a window includes top, bottom, and first and second side members connected together to form a generally rectangular structure. Each frame member includes a pair of elongated, linear members connected lengthwise in a telescoping manner which are hollow and rectangular in cross-section and have respective inner and outer walls. The inner and outer walls of each frame member are each provided with a plurality of spaced apertures, with each pair of aligned apertures in the inner and outer walls adapted to receive a decorative light in a tight-fitting manner. Lights inserted in aligned apertures of a pair of telescoping frame members prevent sliding movement between the frame members. This telescoping connection within each linear frame member in combination with a spring-biased tension cap on the end of each frame member allows the support frame to be adjusted to fit a wide range of window frame heights and widths. The distal end of the elongated, linear member having the larger cross-section includes a generally rectangular slot for receiving the distal end of the smaller member of an adjacent frame member in forming the corners of the rectangular frame structure. Spaced tabs on the smaller frame member inserted through the aperture in the larger adjacent frame member securely connect the two adjacent support frame members in a fixed manner to provide a rigid frame. The ends of each frame member engage facing portions of the window frame for maintaining the decorative lights securely in position within the window frame adjacent the periphery of the pane of glass.

11 Claims, 2 Drawing Sheets

DECORATIVE LIGHT SUPPORT FRAME WITH ADJUSTABLE LENGTH FRAME MEMBERS

FIELD OF THE INVENTION

This invention relates generally to window-mounted decorative light arrays and is particularly directed to a support frame for attaching linear arrays of decorative lights to a window frame adjacent the window's glass pane.

BACKGROUND OF THE INVENTION

Decorative lights are frequently positioned about windows in businesses or homes. The lights may be permanently installed or removably attached to a support structure, which generally is a window frame. Removable light mounting arrangements are particularly used at Christmas time as a seasonal decoration. Examples of ornamental light frames attached by nails or screws can be found in U.S. Pat. Nos. 4,795,121 and 5,580,160, as well as in Des. Patent No. 403,801. U.S. Pat. No. 4,852,832 discloses a decorative light strip holder which is attached to walls or other structures by means of an adhesive. Using nails or screws to mount the light frame renders it more difficult to install and remove the lights, thus rendering this approach impractical for temporary, short term light installations. Using an adhesive tends to be messy and unsightly with each re-installation of the lights involving repeated applications of the adhesive. The use of a tacky surface in mounting the lights is limited in the number of times the lights can be installed.

Whether the decorative light installation is permanent or temporary, it is clearly desirable to allow the lights to be installed in the window regardless of the window's size. Limiting the light support structure to fit only a window of a given size requires a number of different frame sizes to accommodate the wide range of window sizes encountered in various building structures. Requiring a manufacturer to make and stock variously sized decorative light support structures or providing support structures for only a limited range of window sizes would limit the market for these products and render them commercially unattractive to manufacturers. U.S. Pat. Nos. 4,357,653 and 4,995,181 disclose allegedly adjustable decorative light frames, but the adjustability of these approaches lies in cutting the frame member down to size. Obviously, once the frame members are reduced in length, they can no longer accommodate larger windows for displaying the decorative lights.

The present invention addresses the aforementioned limitations of the prior art by providing a decorative light support frame which is adjustable in size to accommodate a wide range of window dimensions and is easily installed and removed from the window frame without requiring fasteners such as nails or screws or an adhesive.

OBJECTS AND SUMMARY OF THE INVENTION

Accordingly, it is an object of the present invention to attach decorative lights to a window frame.

It is another object of the present invention to provide a support frame for attaching decorative lights to a window frame which is adjustable over a wide range of window heights and widths, is easily installed in and removed from the window frame, is sturdy and durable in construction, provides a full view of the lights disposed about the periphery of the window, and is attractive to view.

Yet another object of the present invention is to provide a removable, decorative light mounting arrangement for temporary use in a window which employs neither couplers, such as screws or nails, nor an adhesive.

This invention contemplates a support frame for positioning decorative lights about a pane of glass disposed in a window frame, the support frame comprising a plurality of elongated, linear frame members each disposed adjacent to and aligned with a respective peripheral edge of the pane of glass, wherein each of the frame members includes respective first and second opposed ends and wherein the opposed ends of each frame member engage opposed portions of the window frame, each of the frame members further including a plurality of apertures disposed in a spaced manner along the length of the frame member, wherein each aperture is adapted to receive a respective decorative light in a tight-fitting manner; a connecting arrangement for coupling adjacent frame members adjacent a corner of the window frame; and an adjustable arrangement in each of the frame members for establishing the length of each frame member to fit within and engage the inner opposed portions of the window frame in a tight-fitting manner.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
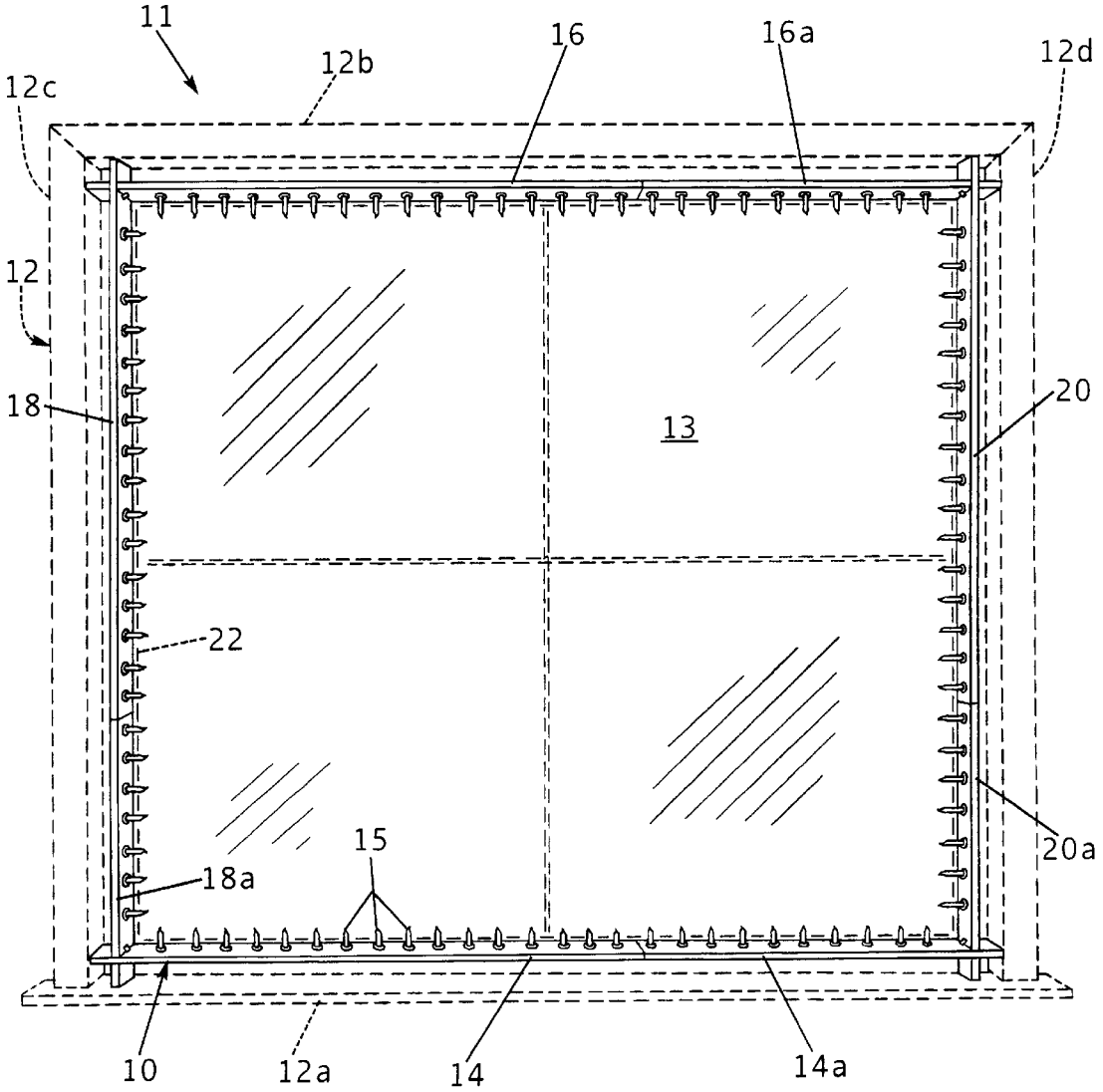
FIG. 1 is an elevation view of a support frame for positioning decorative lights about a window in accordance with the principles of the present invention.

Referring to FIG. 1, there is shown an elevation view of a support frame 10 for securely positioning in a removable manner a plurality of decorative lights 15 about a window 11 (shown in dotted line form) in accordance with the present invention. Window 11 includes one or more panes of glass 13 and a peripheral window sash 22 disposed about the pane, or panes, of glass. The window 11 is positioned within and supported by a window frame 12 which includes a lower member 12*a*, an upper member 12*b*, and first and second side members 12*c* and 12*d*. Window 11 and window frame 12 are generally rectangular in shape and are typically comprised of wood.

The inventive decorative light support frame 10 includes a lower frame member 14, an upper frame member 16, and left and right frame members 18 and 20. Each of the frame members 14, 16, 18 and 20 is linear and elongated and is disposed in closely spaced relation to a corresponding portion of the window frame 12. Thus, lower frame member 14 is disposed adjacent the window frame's lower member 12*a*, while the support frame's upper frame member 16 is disposed in closely spaced relation to the window frame's upper member 12*b*. Similarly, the left and right support frame members 18,20 are respectively disposed in closely spaced relation to the window frame's side members 12*c* and 12*d*. The support frame members 14,16,18 and 20 are coupled together to form a generally rectangular structure and are each adapted to receive and support the decorative lights 15 as described in detail below. The support frame members may be comprised of a suitable metal such as stainless or chrome plated steel or aluminum, or plastic such as polypropylene or polystyrene, or wood. Electrical leads connected to each of the decorative lights 15 (which are not shown in the figure for simplicity) are disposed about the outer periphery of the support frame 10. These electrical leads are hidden from view by the window's peripheral sash 22 as well as by conventional window dressing, i.e., curtains, disposed about an inside portion of the window frame 12.

Figures 2, 3, 4:
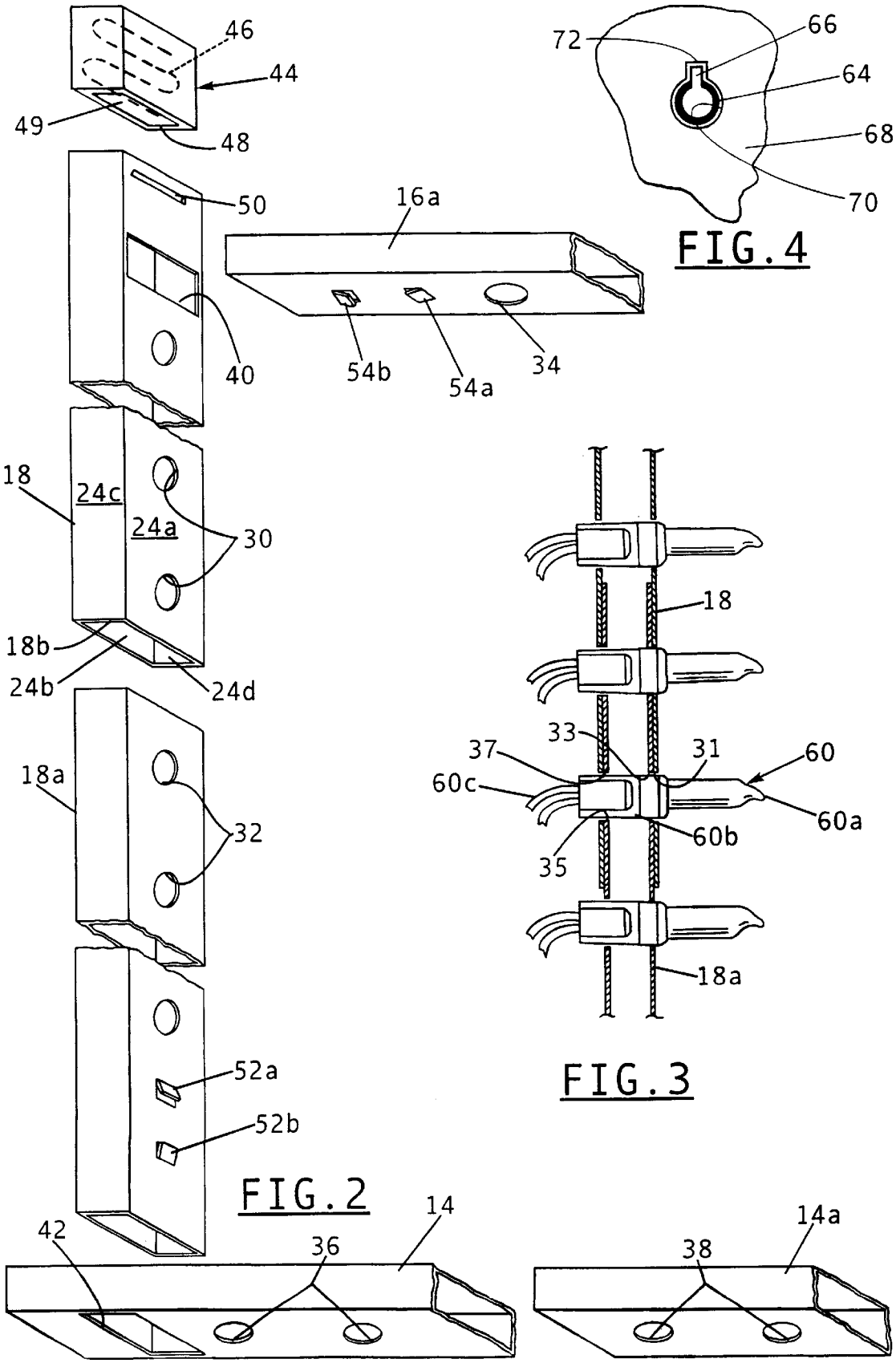
FIG. 2 is a partial exploded perspective view of the decorative light support frame of the present invention.
FIG. 3 is a partial sectional view of a frame member used in the decorative light support frame of the present invention.
FIG. 4 is a partial plan view showing a decorative light positioned in a keyed aperture in a frame member of the inventive support frame.

Referring to FIG. 2, there is shown a partial exploded perspective view of the lower frame member 14 and the left frame member 18. All of the decorative light support frame members are identical in size, shape and configuration, with the following discussion thus applicable to the entire decorative light support frame. Each of the support frame members is generally rectangular in cross section and is hollow. Thus, as shown from the case of the left frame member 18, the frame member includes an inner wall 24*a*, an outer wall 24*b*, and first and second side walls 24*c* and 24*d*. Each frame member also includes an extension member which is inserted telescopically into the larger frame member. Thus, the left frame member 18 is adapted to receive an extension member 18*a* in a telescoping manner. Similarly, the lower frame member 14 is adapted to receive in a telescoping manner an extension member 14*a*. Each of the extension members is smaller in cross section than its associated frame member to allow for insertion of the extension member into the larger frame member. It is this telescoping feature of each of the decorative light support frame members which allows for adjusting the size of the support frame to fit a wide range of window heights and widths as described below.

Disposed along the length of the inner and outer walls of each of the decorative light support frame members in a spaced manner are a plurality of paired circular apertures. Thus, the left frame member 18 is shown as including apertures 30 disposed in a spaced manner along its length. Similarly, extension member 18*a* of the left frame member 18 includes a series of spaced circular apertures 32 along its length. Also as shown in FIG. 2, the lower frame member 14 includes a plurality of spaced apertures 36 along its length, while the extension member 14*a* of the lower frame member also includes a series of spaced circular apertures 38 along its length. The spacing between the apertures on each of the frame members and their associated extension members is equal.

Each of the paired, spaced sets of apertures in the frame member as well as in its associated extension member is adapted to receive a respective decorative light as shown in the partial sectional view of FIG. 3. FIG. 3 shows a partial sectional view of the left frame member 18 and its associated extension member 18*a*. Extension member 18*a* is inserted within the left frame member 18 in a sliding manner. When the length of the frame member 18 and extension member 18*a* matches the corresponding dimension of the window frame in which the decorative light support frame is to be placed, respective pairs of spaced apertures in the frame and the extension members are placed in common alignment. Thus, as shown in FIG. 3, aperture 31 and aperture 33 in the adjacent walls of the left frame member 18 and its extension member 18*a* are positioned in alignment. Similarly, apertures 35 and 37 in the outer walls of the left frame member 18 and its extension member 18*a*, respectively, are aligned. Thus, all four apertures 31,33,35 and 37 are in common alignment for receiving a decorative light 60. Decorative light 60 includes a bulb 60*a* and a socket 60*b*. Electrical leads 60*c* are connected to and extend from the light's socket 60*b*. The light 60 is inserted in the aforementioned aligned apertures such that its socket 60*b* is positioned within the apertures and engages adjacent portions of the left frame member 18 and extension member 18*a* in a tight-fitting manner. By positioning the decorative light 60 as well as a plurality of decorative lights in the spaced aligned apertures as shown in FIG. 3, the left frame member 18 and its extension member 18a are maintained in fixed relation with a given combined length, which length matches the distance between the facing portions of the window frame between which the frame member and extension member are positioned.

In some cases as shown in FIG. 4, a light socket 64 may include an extension portion 66. In this case, aligned apertures 70 in the outer wall 68 and the inner wall of a frame member and its associated extension member may be provided with a notched-out portion 72 to accommodate the socket 64 in a keyed manner.

Adjacent ends of decorative light support frame members are adapted for coupling together in the following manner. As shown in FIG. 2, the lower frame member 14 is provided with a generally rectangular slot 42 adjacent an end thereof. Similarly, the distal end of the left frame member 18 is provided with a generally rectangular slot 40. Slot 42 is adapted to receive an end of the extension member 18*a* of the left frame member 18 in a sliding manner. Similarly, the rectangular slot 40 in the left frame member 18 is adapted to receive an extension member 16*a* of the upper frame member. First and second spaced tabs 52*a* and 52*b* on extension member 18*a* are adapted to securely engage opposed walls of the lower frame member 14 for securely connecting left and lower frame members. Similarly, first and second spaced tabs 54*a* and 54*b* on the extension member 16*a* engage respective, opposed surfaces of the left frame member 18 and prevent removal of the extension member from the left frame member.

In one embodiment, each of the decorative light frame members is ⅜" thick and ⅞" wide. The apertures in the inner and outer walls of a decorative light frame member are respectively 0.20" and 0.32" in diameter.

Disposed on an end of each of the decorative light support frame members is an end cap. Thus, as shown in FIG. 2, end cap 44 is adapted for tight-fitting positioning on the end of the left frame member 18. End cap 44 has a generally rectangular cross section and includes an open end 49 defined by an inner edge, or flange, 48. Disposed on the distal end of the left frame member 18 is an outwardly extending tab 50. When the end cap 44 is positioned on the end of the left frame member 18, the frame member's tab 50 is disposed within the end cap. An attempt to remove the end cap 44 from the end of the left frame member 18 results in contact between the tab 50 and the end cap's flange 48 preventing removal of the end cap from the end of the frame member. Disposed within the end cap 44 is a spring 46 which engages the end of the left frame member 18 positioned within the end cap. Spring 46 and urges the end cap 44 outwardly from the end of the left frame member 18. By urging the end cap 44 outwardly from the end of the left frame member 18, the opposed ends of the frame member are maintained in tight-fitting engagement with facing portions of the window frame as shown in FIG. 1. Although spring 46 is shown in FIG. 2 as a snake-like spring, it may be virtually any type of spring such as a coil spring, a leaf spring, etc.

There has thus been shown a support frame for decorative lights disposed about a window and engaging the window's frame. The support frame includes a plurality of elongated, linear frame members connected together to form a closed structure disposed about the outer periphery of the window. Each of the frame members can be either lengthened or shortened in a telescoping manner to allow the support frame to fit a wide range of window frame sizes. Each frame member further includes an outwardly biased end cap for maintaining opposed ends of the frame member in tight-fitting engagement with facing portions of the window frame. Each frame member is generally rectangular in cross section and includes first and second pluralities of spaced apertures in its inner and outer walls, respectively. Each pair of aligned apertures is adapted to receive in tight-fitting engagement the socket of a decorative light. Electrical leads for the lights are disposed about the outer periphery of the support frame in close proximity to the window frame and are typically hidden from view by the window's peripheral sash. The ends of adjacent frame members are adapted for tight-fitting engagement by means of a slot and retaining tab arrangement.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A support frame for positioning decorative lights about a pane of glass disposed in a window frame, said support frame comprising:

a plurality of elongated, linear frame members each disposed adjacent to and aligned with a respective peripheral edge of the pane of glass, wherein each of said frame members includes respective first and second opposed ends and wherein the opposed ends of each frame member engage opposed portions of the window frame, each of said frame members further including means for defining a plurality of apertures disposed in a spaced manner along the length of said frame member, wherein each aperture is adapted to receive a respective decorative light in a tight-fitting manner;

means for coupling adjacent frame members adjacent a corner of the window frame; and adjustable means in each of said frame members for establishing the length of each frame member to fit within and engage the opposed portions of the window frame in a tight-fitting manner, wherein each of said frame members is generally rectangular in cross section and includes an inner wall and an outer wall, and wherein said inner wall includes a first plurality of spaced apertures and said outer wall includes a second plurality of spaced apertures, and wherein each of said first plurality of apertures is aligned with a respective one of said second plurality of apertures, and wherein each pair of aligned apertures is adapted to receive a respective decorative light.

2. The support frame of claim 1 wherein each frame member further includes a first outer member and a second inner member telescopically coupled together, and wherein said first outer and second inner members respectively include first and second pluralities of paired apertures disposed in a spaced manner along their respective lengths, and wherein each light is inserted into aligned first and second paired apertures in said first outer and second inner members.

3. The support frame of claim 2 wherein each decorative light includes a bulb and a socket, and wherein each socket is inserted in aligned first and second paired apertures in said first outer and second inner members in a tight-fitting manner.

4. The support frame of claim 1 wherein each of said frame members further includes a respective end cap displaced outwardly from an end of the frame member for engaging the window frame under tension.

5. The support frame of claim 4 wherein said end cap includes a generally hollow member having an aperture for receiving an end of a frame member and a spring engaging an end of the frame member and disposed within and urging said hollow member away from said frame member and into secure engagement with the window frame.

6. The support frame of claim 5 further comprising means for retaining said hollow member on an end of a frame member.

7. The support frame of claim 6 wherein said means for retaining said hollow member on a frame member includes a flange disposed about the aperture in said hollow member and a tab disposed on an outer surface of said frame member adjacent an edge thereof for engaging said flange and preventing removal of said hollow body from the end of said frame member.

8. The support frame of claim 1 wherein each of said frame members includes a slot adjacent an end thereof, and wherein said slot is adapted to receive in tight-fitting engagement an end of an adjacent frame member.

9. The support frame of claim 8 wherein said adjacent frame member includes a pair of spaced tabs on an outer surface thereof, and wherein said tabs engage said frame member when said adjacent frame member is inserted in said frame member to prevent withdrawal of said adjacent frame member from said frame member.

10. The support frame of claim 9 wherein each of said frame members has a generally rectangular cross section and includes a first outer member and a second inner member telescopically coupled together and wherein said slot is disposed adjacent an end of said first outer member and is adapted to receive in tight-fitting engagement a second inner member of an adjacent frame member.

11. An arrangement for positioning decorative lights about the periphery of a pane of glass disposed in a window frame, said arrangement comprising:

a plurality of linear, elongated frame members each disposed within the window frame and adjacent to the pane of glass;

means for coupling opposed ends of each frame member to a respective end of an adjacent frame member;

means for adjusting the length of each frame member to fit within the window frame such that opposed ends of each frame member engage the window frame; and extension means disposed on each frame member for extending the frame member lengthwise for placing the ends of each frame member in intimate contact with facing portions of the window frame, wherein each of said frame members is generally rectangular in cross section and includes an inner wall and an outer wall and wherein said inner wall includes a first plurality of spaced apertures and said outer wall includes a second plurality of spaced apertures, and wherein each of said first plurality of apertures is aligned with a respective one of said second plurality of apertures, and wherein each pair of aligned apertures is adapted to receive a respective decorative light.

* * * * *